US008326769B1

(12) United States Patent
Weisman

(10) Patent No.: US 8,326,769 B1
(45) Date of Patent: Dec. 4, 2012

(54) MONETARY TRANSFER IN A SOCIAL NETWORK

(75) Inventor: David Weisman, San Francisco, CA (US)

(73) Assignee: Google Inc., Mountain View, CA (US)

( * ) Notice: Subject to any disclaimer, the term of this patent is extended or adjusted under 35 U.S.C. 154(b) by 0 days.

(21) Appl. No.: 13/175,271

(22) Filed: Jul. 1, 2011

(51) Int. Cl.
*G06Q 99/00* (2006.01)

(52) U.S. Cl. ..... 705/319; 705/34; 707/798

(58) Field of Classification Search ..... 705/30, 705/34, 319, 35; 455/414.1; 370/352; 707/732, 707/736, 748, 749, 758, 769, 798; 709/203, 709/217, 223, 224, 226, 227
See application file for complete search history.

(56) References Cited

U.S. PATENT DOCUMENTS

| | | | | |
|---|---|---|---|---|
| 6,130,938 | A | 10/2000 | Erb | |
| 6,192,119 | B1 | 2/2001 | Wilson | |
| 6,697,478 | B1 | 2/2004 | Meldrum et al. | |
| 6,754,322 | B1 | 6/2004 | Bushnell | |
| 7,106,848 | B1 | 9/2006 | Barlow et al. | |
| 7,366,990 | B2 | 4/2008 | Pitroda | |
| 7,555,110 | B2 | 6/2009 | Dolan et al. | |
| 7,610,287 | B1 | 10/2009 | Dean et al. | |
| 7,698,218 | B1 * | 4/2010 | Opaluch et al. | 705/40 |
| 7,730,063 | B2 | 6/2010 | Eder | |
| 7,742,468 | B2 | 6/2010 | Vagelos | |
| 7,797,256 | B2 * | 9/2010 | Zuckerberg et al. | 705/319 |
| 7,826,421 | B2 * | 11/2010 | Pousti et al. | 370/329 |
| 7,826,829 | B2 * | 11/2010 | Pousti | 455/414.1 |
| 7,844,634 | B2 * | 11/2010 | Hildrum et al. | 707/798 |
| 7,877,082 | B2 | 1/2011 | Eagle et al. | |
| 7,881,702 | B2 * | 2/2011 | Heyworth et al. | 455/414.1 |
| 7,925,743 | B2 | 4/2011 | Neely et al. | |
| 8,010,619 | B1 * | 8/2011 | Lawler et al. | 709/217 |
| 8,015,119 | B2 * | 9/2011 | Buyukkokten et al. | 705/319 |
| 8,019,875 | B1 * | 9/2011 | Nielsen | 709/227 |
| 8,046,411 | B2 * | 10/2011 | Hayashi et al. | 709/204 |
| 8,073,733 | B1 | 12/2011 | Caland | |
| 8,090,666 | B2 * | 1/2012 | Sarbaev et al. | 705/319 |
| 8,108,501 | B2 | 1/2012 | Bimie et al. | |
| 8,147,328 | B2 * | 4/2012 | Carroll et al. | 463/29 |
| 8,180,804 | B1 * | 5/2012 | Narayanan et al. | 707/798 |

(Continued)

FOREIGN PATENT DOCUMENTS

WO WO02079984 10/2002

OTHER PUBLICATIONS

Adamic et al., "A Social Network Caught in the Web," Internet Journal, First Monday, Jun. 2, 2003, pp. 1-22, vol. 8, No. 6.

(Continued)

*Primary Examiner* — Andrew Joseph Rudy
(74) *Attorney, Agent, or Firm* — Patent Law Works LLP

(57) ABSTRACT

A method and system for billing and paying friends on a social network is described. A monetary transfer module generates an invoice for sharing an expense with at least one friend on a social network. The monetary transfer module identifies users on the social network. The monetary transfer module generates a group that includes the users based at least in part on at least one common feature between the users. At least one of the users included in the group incurs an expense. The monetary transfer module generates an invoice for paying for the expense. The monetary transfer module sends a notification to at least one of the users that includes the invoice.

20 Claims, 14 Drawing Sheets

U.S. PATENT DOCUMENTS

| | | | | |
|---|---|---|---|---|
| 8,185,558 | B1 * | 5/2012 | Narayanan et al. | 707/798 |
| 8,224,727 | B2 * | 7/2012 | Hirson et al. | 705/35 |
| 2002/0137490 | A1 | 9/2002 | Gallant | |
| 2002/0143874 | A1 | 10/2002 | Marquette et al. | |
| 2004/0258220 | A1 | 12/2004 | Levine et al. | |
| 2005/0152521 | A1 | 7/2005 | Liljestrand | |
| 2006/0026288 | A1 | 2/2006 | Acharya et al. | |
| 2006/0077957 | A1 | 4/2006 | Reddy et al. | |
| 2006/0206604 | A1 | 9/2006 | O'Neil et al. | |
| 2007/0127631 | A1 | 6/2007 | Difiglia | |
| 2007/0171898 | A1 | 7/2007 | Salva | |
| 2007/0173236 | A1 | 7/2007 | Vishwanathan et al. | |
| 2007/0248077 | A1 | 10/2007 | Mahle, Jr. et al. | |
| 2007/0281716 | A1 * | 12/2007 | Altman et al. | 455/466 |
| 2007/0299678 | A1 * | 12/2007 | Kido | 705/1 |
| 2008/0056475 | A1 | 3/2008 | Brannick et al. | |
| 2008/0192656 | A1 | 8/2008 | Vagelos | |
| 2008/0253363 | A1 | 10/2008 | Altberg et al. | |
| 2011/0098156 | A1 | 4/2011 | Ng et al. | |

OTHER PUBLICATIONS

Agarwal et al., "Enabling Real-Time User Interests for Next Generation Activity-Oriented Social Networks," Thesis submitted to the Indian Institute of Technology Delhi, Department of Computer Science & Engineering, 2005, 70 pgs.

Anwar et al., "Leveraging 'Social-Network' Infrastructure to Improve Peer-to Peer Overlay Performance: Results from Orkut," University of Illinois at Urbana-Champaign USA, 2005, 9 pgs.

AT&T Personal Reach Service: Benefits and Features, Mar. 29, 2010, 7 pgs.

AT&T Personal Reach Service: Personal Reach Service, Mar. 29, 2010, 2 pgs.

Baird et al., "Neomillennial User Experience Design Strategies: Utilizing Social Networking Media to Support "Always On" Learning Styles," J. Educational Technology Systems, vol. 34(1), 2005-2006, Baywood Publishing Co., Inc., pp. 5-32.

Boyd, et al., "Social Network Sites: Definition, History, and Scholarship," Journal of Computer-Mediated Communication, International Communication Association, 2008, pp. 210-230.

Churchill et al., "Social Networks and Social Networking," IEEE Computer Society, Sep.-Oct. 2005, pp. 14-19.

Cohen et al., "Social Networks for Creative Collaboration," C&C '05, Apr. 12-15, 2005, pp. 252-255, London, United Kingdom.

Decker et al., "The Social Semantic Desktop," Digital Enterprise Research Institute, DERI Galway, Ireland, DERI Innsbruck, Austria, DERI Technical Report, May 2, 2004, 7 pgs.

Dukes-Schlossberg et al., "Battlefield Awareness and Data Dissemination Intelligent Information Dissemination Server," Air Force Research Laboratory, Rome Research Site, Rome, NY, Nov. 1, 1999, 31 pgs.

Eagle et al., "Social Serendipity: Proximity Sensing and Cueing," MIT Media Laboratory Technical Note 580, May 2004, 18 pgs.

Erickson et al., "Social Translucence: Using Minimalist Visualizations of Social Activity to Support Collective Interaction," Designing Information Spaces: The Social Navigation Approach, Springer-verlag: London, 2003, pp. 1-19.

Gross et al., "Information Revelation and Privacy in Online Social Networks," WPES '05, Alexandria, Virginia, Nov. 7, 2005, pp. 71-80.

Hammond et al., "Social Bookmarking Tools (I)," D-Lib Magazine, Apr. 2005, vol. II, No. 4, ISSN 1082-9873, 23 pgs.

Heer et al., "Vizster: Visualizing Online Social Networks," University of California, Berkeley, 8 pgs.

International Search Report, International Application No. PCT/US2008/005118, Sep. 30, 2008, 2 pgs.

Leonard, "You Are Who You Know," Internet, retrieved at http://www.salon.com, Jun. 15, 2004, 15 pgs.

LiveJournal, "FAQ #163: How Do I Find a Syndicated Account?" Last Updated: thebubba, Jan. 6, 2004, 2 pgs.

Marwick, "Selling Your Self: Online Identity in the Age of a Commodified Internet," University of Washington, 2005, 192 pgs.

MediaSift Ltd., DataSift: Realtime Social Data Mining Platform, Curate and Data Mine the Real Time Web with DataSift, Dedipower, Managed Hosting, May 13, 2011, 1 pg.

Metcalf et al., "Spatial Dynamics of Social Network Evolution," 23rd International Conference of the System Dynamics Society, Jul. 19, 2005, pp. 1-13.

Mori et al., "Real-world Oriented Information Sharing Using Social Networks," Group '05, Sanibel Island, Florida, USA, Nov. 6-9, 2005, pp. 81-84.

Murchu et al., "Online Social and Business Networking Communities," Digital Enterprise Research Institute DERI Technical Report, National University of Ireland, Aug. 8, 2004, 22 pgs.

Nardi et al., "Blogging as Social Activity, or, Would You Let 900 Million People Read Your Diary?" CSCW'04, Nov. 6-10, 2004, vol. 6, Issue 3, Chicago, Illinois, pp. 222-231.

Neumann et al., "Semantic social network portal for collaborative online communities," Journal of European Industrial Training, 2005, Emerald Group Publishing, Limited, vol. 29, No. 6, pp. 472-487.

Ring Central, Inc., Internet, retrieved at http://www.ringcentral.com, Apr. 19, 2007, 1 pg.

Singh et al., "CINEMA: Columbia InterNet Extensible Multimedia Architecture," Department of Computer Science, Columbia University, pp. 1-83.

Steen et al., "Development of we-centric, context-aware, adaptive mobile services requires empathy and dialogue," Freeband FRUX, Oct. 17, 2005, Internet Journal, Netherlands, pp. 1-4.

Superfeedr Track, Internet, retrieved at http://blog.superfeedr.com/track/filter/xmpp/pubsubhubbub/track, May 13, 2011, 8 pgs.

Twitter Blog: Tracking Twigger, Internet, retrieved at http://blog.twitter.com/2007/09/tracking-twitter.html, May 13, 2011, 2 pgs.

Twitter Announces Fire Hose Marketplace: Up to 10K Keyword Filters for 30 Cents, Internet, retrieved at http://www.readywriteweb.com/archives/twitter_announces_fire_hose_marketplace_up_to_10k.php, May 13, 2011, 7 pgs.

Van Eijk et al., "We-centric, context-aware, adaptive mobile service bundles," Freeband, Telematica Instituut, TNO telecom, Nov. 30, 2004, 48 pgs.

Wenger et al., "Technology for Communities," CEFRIO Book Chapter v 5.2, Jan. 18, 2005, pp. 1-15.

* cited by examiner

850

950

1050

MONETARY TRANSFER IN A SOCIAL NETWORK

The specification relates to a system and method for sharing expenditures on a social network. In particular, the specification relates to billing and receiving payment from users on a social network.

BACKGROUND

Situations frequently arise where a group of people are responsible for paying for an expense. A group of friends that dine together at a restaurant incur a bill. Roommates that share a rental apartment or a house incur rent and other monthly expenses. Friends will often pool their resources to buy a single gift for a friend. In these examples, one person (the payer) pays the restaurant, rental owner, utility company or retailer to cover the incurred expense. As a result, other friends or roommates owe the payor their share of the original bill.

The non-paying members of the group are now responsible for reimbursing the payor. These group members may have cash or checks to give to the payer. Other times they do not have cash or checks handy to cover their portion of the original bill. Also, people may be remotely located, which makes a cash or check transaction inconvenient.

SUMMARY OF THE INVENTION

In some examples, the specification provides a method and system for billing and receiving payment from users on a social network. In one embodiment, a monetary transfer module comprises a monetary request module, a payment processing engine, a financial institution interface module, a user interface engine, a registration module and a group engine. The monetary request module generates requests for a monetary transfer such as money or other currency such as virtual credit. The payment processing engine triggers payments or currency transfers. The financial institution interface module communicates with at least one financial institution server and electronic payment provider. The user interface engine generates a user interface that receives inputs from users and/or displays information to users. The registration module registers payment types. The group engine generates groups for billing and transferring money or currency.

In one embodiment, the monetary transfer module receives a request for invoicing a first user from a second user. The monetary transfer module identifies the first user and the second user. The monetary transfer module determines a link or a relationship between the first user and the second user. The monetary transfer module determines whether the first user and the second user are friends on a social network. The monetary transfer module notifies the first user that the second user requests a payment. The monetary transfer module notifies the first user by sending an email message, creating a comment or post on the social network, text messaging, sending a multimedia message, or sending an alert notification to the user device via the social network application. The monetary transfer module receives authorization to trigger a payment for paying the second user from the first user. The monetary transfer module triggers the payment for paying the second user.

In one embodiment, an expenditure is associated with an interaction on a social network between the members. The monetary transfer module identifies users on the social network. The monetary transfer module generates a group that includes the users based at least in part on at least one common feature between the users. At least one of the users included in the group incurs an expense. The monetary transfer module generates an invoice for paying for the expense. The monetary transfer module sends a notification to at least one of the users that includes the invoice.

In one embodiment, the specification includes a computer program product comprising a computer useable medium including a computer readable program, wherein the computer readable program when executed on a computer causes the computer to generate a request for a payment from at least one member of a social network.

BRIEF DESCRIPTION OF THE DRAWINGS

The specification is illustrated by way of example, and not by way of limitation in the figures of the accompanying drawings in which like reference numerals are used to refer to similar elements.

DETAILED DESCRIPTION OF THE PREFERRED EMBODIMENTS

Figure 1A:
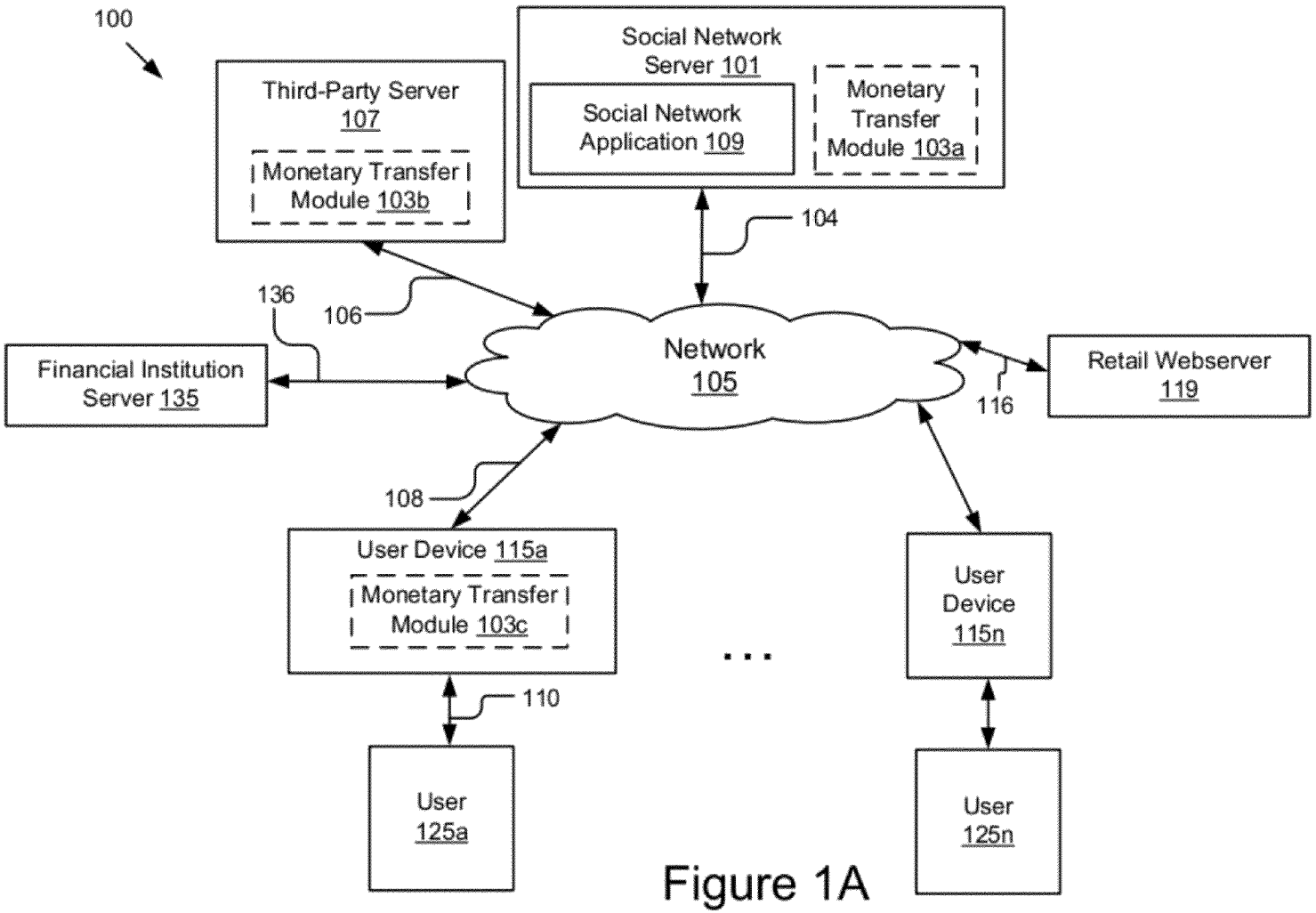
FIG. 1*a* is a high-level block diagram illustrating one embodiment of a system for transferring money or other currency in a social network.

A system and method for billing and receiving payment from users in a social network is described below. In the following description, for purposes of explanation, numerous specific details are set forth in order to provide a thorough understanding of the specification. It will be apparent, however, to one skilled in the art that the embodiments can be practiced without these specific details. In other instances, structures and devices are shown in block diagram form in order to avoid obscuring the specification. For example, the specification is described in one embodiment below with reference to user interfaces and particular hardware. However, the description applies to any type of computing device that can receive data and commands, and any peripheral devices providing services.

Reference in the specification to "one embodiment" or "an embodiment" means that a particular feature, structure, or characteristic described in connection with the embodiment is included in at least one embodiment. The appearances of the phrase "in one embodiment" in various places in the specification are not necessarily all referring to the same embodiment.

Some portions of the detailed descriptions that follow are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers or the like.

It should be borne in mind, however, that all of these and similar terms are to be associated with the appropriate physical quantities and are merely convenient labels applied to these quantities. Unless specifically stated otherwise as apparent from the following discussion, it is appreciated that throughout the description, discussions utilizing terms such as "processing" or "computing" or "calculating" or "determining" or "displaying" or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

The specification also relates to an apparatus for performing the operations herein. This apparatus may be specially constructed for the required purposes, or it may comprise a general-purpose computer selectively activated or reconfigured by a computer program stored in the computer. Such a computer program may be stored in a computer readable storage medium, such as, but is not limited to, any type of disk including floppy disks, optical disks, CD-ROMs, and magnetic disks, read-only memories (ROMs), random access memories (RAMs), EPROMs, EEPROMs, magnetic or optical cards, flash memories including USB keys with non-volatile memory or any type of media suitable for storing electronic instructions, each coupled to a computer system bus.

Some embodiments can take the form of an entirely hardware embodiment, an entirely software embodiment or an embodiment containing both hardware and software elements. A preferred embodiment is implemented in software, which includes but is not limited to firmware, resident software, microcode, etc.

Furthermore, some embodiments can take the form of a computer program product accessible from a computer-usable or computer-readable medium providing program code for use by or in connection with a computer or any instruction execution system. For the purposes of this description, a computer-usable or computer readable medium can be any apparatus that can contain, store, communicate, propagate, or transport the program for use by or in connection with the instruction execution system, apparatus, or device.

A data processing system suitable for storing and/or executing program code will include at least one processor coupled directly or indirectly to memory elements through a system bus. The memory elements can include local memory employed during actual execution of the program code, bulk storage, and cache memories which provide temporary storage of at least some program code in order to reduce the number of times code must be retrieved from bulk storage during execution.

Input/output or I/O devices (including but not limited to keyboards, displays, pointing devices, etc.) can be coupled to the system either directly or through intervening I/O controllers.

Network adapters may also be coupled to the system to enable the data processing system to become coupled to other data processing systems or remote printers or storage devices through intervening private or public networks. Modems, cable modem and Ethernet cards are just a few of the currently available types of network adapters.

Finally, the algorithms and displays presented herein are not inherently related to any particular computer or other apparatus. Various general-purpose systems may be used with programs in accordance with the teachings herein, or it may prove convenient to construct more specialized apparatus to perform the required method steps. The required structure for a variety of these systems will appear from the description below. In addition, the specification is not described with reference to any particular programming language. It will be appreciated that a variety of programming languages may be used to implement the teachings of the various embodiments as described herein.

System Overview

FIG. 1*a* illustrates a block diagram of a system 100 for transferring monetary in a social network according to one embodiment. The system 100 includes user devices 115*a*, 115*n* that are accessed by users 125*a*, 125*n*, a social network server 101, a third-party server 107, a financial institution server 135, and a retail webserver 119. In FIG. 1*a* and the remaining figures, a letter after a reference number, such as "115*a*" is a reference to the element having that particular reference number. A reference number in the text without a following letter, such as "115," is a general reference to any or all instances of the element bearing that reference number. In the illustrated embodiment, these entities are communicatively coupled via a network 105. Although only two devices are illustrated, persons of ordinary skill in the art will recognize that any number of user devices 115*n* are available to any number of users 125*n*. Furthermore, while only one network 105 is coupled to the user devices, 115*a*, 115*b*, the social network server 101 and the third-party server 107, in practice any number of networks 105 can be connected to the entities.

In one embodiment, the monetary transfer module 103*a* is operable on the social network server 101, which is coupled to the network 105 via signal line 104. The social network server 101 also contains a social network application 109 that generates a social network and includes storage (not shown) for maintaining a record of users and their relationships to each other, e.g. a social graph. In one embodiment, the social network server 101 is powered by Google®. In another embodiment, the monetary transfer module 103*a* is a component of the social network application 109. Although only one social network server 101 is shown, persons of ordinary skill in the art will recognize that multiple servers may be present.

A social network is any type of social structure where the users are connected by a common feature, for example, Orkut. The common feature includes a friendship, a connection with a family member, a connection with a coworker, an interest, etc. The common features are provided by one or more social networking systems, such as those included in the system 100, including explicitly-defined relationships and relationships implied by social connections with other online users, where the relationships form a social graph. In some examples, the social graph reflects a mapping of these users and how they are related.

In another embodiment, the monetary transfer module 103*b* is stored on a third-party server 107, which is connected to the network 105 via signal line 106. The third-party server 107 includes, for example, an application that generates a website that displays information generated by the monetary transfer module 103*b*. For example, the website includes a section of embeddable code for displaying a request for a monetary transfer on a website that displays a blog about a charity.

In another embodiment, the monetary transfer module 103*c* is stored on a user device 115*a*, which is connected to the network 105 via signal line 108. The user 125*a* interacts with the user device 115*a* via signal line 110. The user device 115*a*, 115*n* is any computing device. For example, the user device 115*a*, 115*n* is a personal computer ("PC"), a cell phone (e.g., a smart phone, a feature phone, a dumb phone, etc.), a tablet computer (or tablet PC), a laptop, etc. In one embodiment, the system 100 comprises a combination of different types of user devices 115*a*, 115*n*. For example, a first user device 115*a* is a smart phone, a second user device is a personal computer and a plurality of other user devices 115*n* is any combination of a personal computer, a smart phone and a tablet computer. Persons of ordinary skill in the art will recognize that the monetary transfer module 103 can be stored in any combination on the devices and servers. Furthermore, while only one third-party server 107 is shown, the system 100 could include one or more third-party servers 107.

The network 105 is a conventional type, wired or wireless, and may have any number of configurations such as a star configuration, token ring configuration or other configurations known to those skilled in the art. Furthermore, the network 105 may comprise a local area network (LAN), a wide area network (WAN) (e.g., the Internet), and/or any other interconnected data path across which multiple devices may communicate. In yet another embodiment, the network 105 may be a peer-to-peer network. The network 105 may also be coupled to or includes portions of a telecommunications network for sending data in a variety of different communication protocols. In yet another embodiment, the network 105 includes Bluetooth communication networks or a cellular communications network for sending and receiving data such as via short messaging service (SMS), multimedia messaging service (MMS), hypertext transfer protocol (HTTP), direct data connection, WAP, email, etc.

The monetary transfer module 103 receives data for providing a service to users for requesting and transferring money or other currency to users of a group after the users incur an expense. In one embodiment, the monetary transfer module receives data from a third-party server 107, a social network server 101, user devices 115*a*, 115*n*, a financial institution server 135 that is coupled to the network 105 via signal line 136 and a retail webserver 119 that is coupled to the network 105 via signal line 116. The users of a group incur an expense, for example, by sharing a meal at a restaurant or purchasing an item from a retail webserver 119. The monetary transfer module 103 identifies users, generates an invoice and sends a notification that includes the invoice to at least one of the users. In one embodiment, the monetary transfer module 103*a* processes transactions internally. In another embodiment, the monetary transfer module 103*a* communicates with a financial institution server 135 such as a bank.

Monetary Transfer Module 103

Figure 1B:
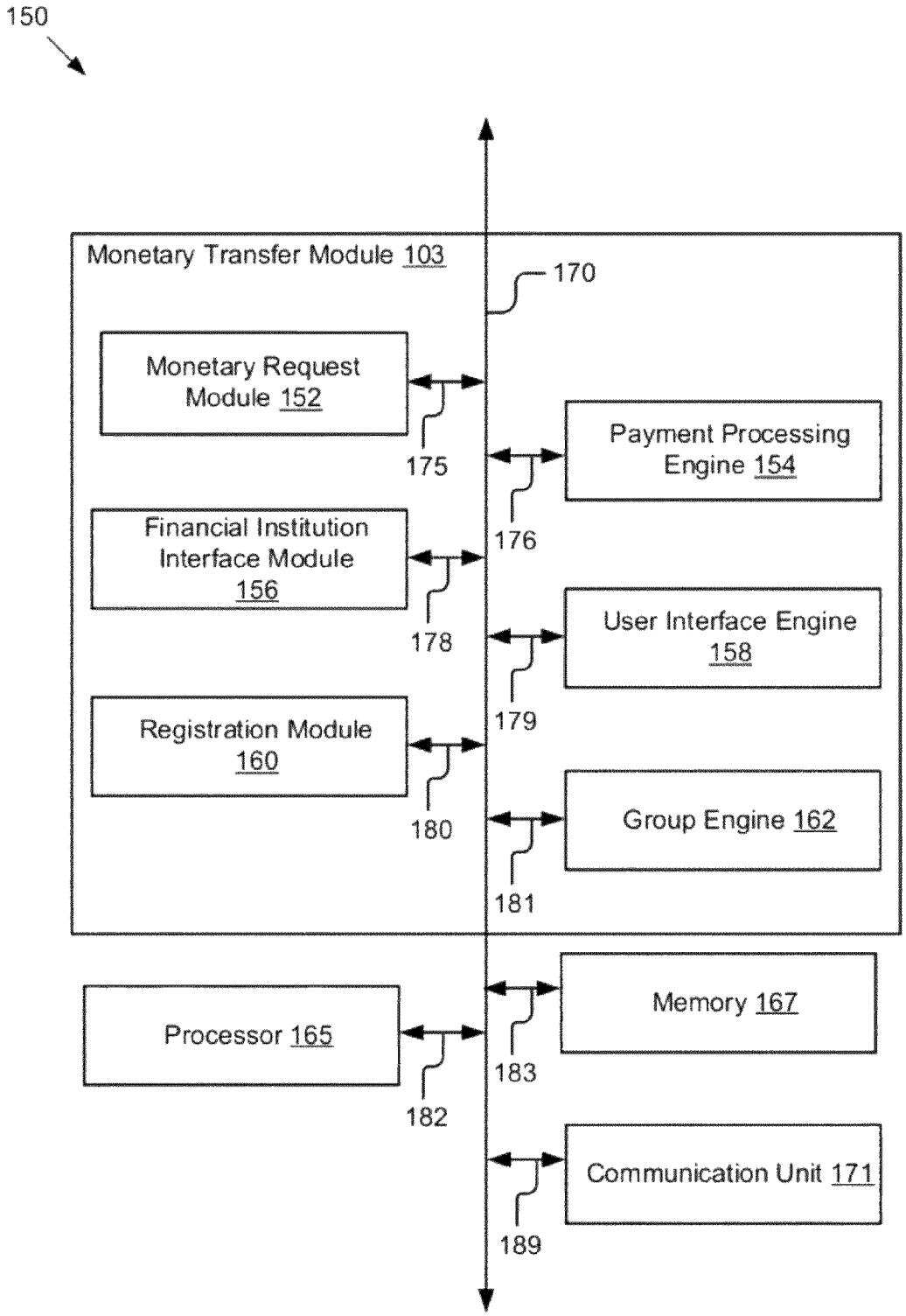
FIG. 1*b* is a block diagram illustrating one embodiment of a monetary transfer module.

Referring now to FIG. 1*b*, the monetary transfer module 103 is shown in more detail. FIG. 1*b* is a block diagram of a computing device 150 that includes the monetary transfer module 103, a memory 167, a processor 165 and a communication unit 171. Optionally, the computing device 150 is a social network server 101. In another embodiment, the computing device 150 is a third-party server 107. In yet another embodiment, the computing device 150 is a user device 115*a*.

The processor 165 comprises an arithmetic logic unit, a microprocessor, a general purpose controller or some other processor array to perform computations and provide electronic display signals to a display device. The processor 165 is coupled to the bus 170 for communication with the other components via signal line 182. Processor 165 processes data signals and may comprise various computing architectures including a complex instruction set computer (CISC) architecture, a reduced instruction set computer (RISC) architecture, or an architecture implementing a combination of instruction sets. Although only a single processor is shown in FIG. 1*b*, multiple processors may be included. The processing capability may be limited to supporting the display of images and the capture and transmission of images. The processing capability might be enough to perform more complex tasks, including various types of feature extraction and sampling. It will be obvious to one skilled in the art that other processors, operating systems, sensors, displays and physical configurations are possible.

The memory 167 stores instructions and/or data that may be executed by the processor 165. The memory 167 is coupled to the bus 170 for communication with the other components via signal line 183. The instructions and/or data may comprise code for performing any and/or all of the techniques described herein. The memory 167 may be a dynamic random access memory (DRAM) device, a static random access memory (SRAM) device, flash memory or some other memory device known in the art. In one embodiment, the memory 167 also includes a non-volatile memory or similar permanent storage device and media such as a hard disk drive, a floppy disk drive, a CD-ROM device, a DVD-ROM device, a DVD-RAM device, a DVD-RW device, a flash memory device, or some other mass storage device known in the art for storing information on a more permanent basis.

The communication unit 171 receives data from a third-party server 107, a social network server 101, a financial institution server 135, a retail webserver 199 or another user device 115*n*. The communication unit 171 transmits the data to the monetary transfer module 103. The communication unit 171 is coupled to the bus 170 via signal line 189. In one embodiment, the communication unit 171 includes a port for direct physical connection to the network 105 or to another communication channel. For example, the communication unit 171 includes a USB, SD, CAT-5 or similar port for wired communication with the network 105. In another embodiment, the communication unit 171 includes a wireless transceiver for exchanging data with the network, or with another communication channel, using one or more wireless communication methods, such as IEEE 802.11, IEEE 802.16, BLUETOOTH®, near field communication (NFC) or another suitable wireless communication method. In one embodiment, the communication unit 171 includes a NFC chip that generates a radio frequency (RF) for short-range communication. In one embodiment, the monetary transfer module 103 comprises a monetary request module 152, a payment processing engine 154, a financial institution interface module 156, a user interface engine 158, a registration module 160 and a group engine 162.

The monetary request module 152 is software including routines for generating requests for money or other currency. In one embodiment, the monetary request module 152 is a set of instructions executable by the processor 165 to provide the functionality described below for generating a request for money or other currency and for sending a notification via the communication unit 171 to at least one user. In another embodiment, the monetary request module 152 is stored in the memory 167 of the computing device 150 and is accessible and executable by the processor 165. In either embodiment, the monetary request module 152 is coupled to the bus 170 for communication with the processor 165 and other components of the computing device 150 via signal line 175.

The monetary request module 152 generates an invoice for sharing an expense with at least one friend on a social network. In one embodiment, a person or a group incurs an expense at a physical location of business. For example, a group incurs an expense by dining at a restaurant. In another embodiment, a group incurs an expense by ordering at least one item from an online store, such as one hosted by a retail webserver 119. The monetary request module 152 determines the relationship between at least two users on a social network. In one embodiment, the relationship is parameterized and exceeds a predetermined threshold. For example, the monetary request module 152 receives a social graph that includes a list of friends in a social network. The parameter is the degree of friendship and the predetermined threshold is, for example, three degrees of friendship. As a result, if the two users are four degrees of friendship apart, the monetary request module 152 will not generate an invoice. When the relationship is between a user and a group (i.e. an organization), the monetary request module 152 confirms that the user has indicated a type of approval of the group (like, thumbs up, +1, etc.) before generating an invoice. In another embodiment, the monetary request module 152 generates an invoice responsive to receiving a confirmation from the communication unit 171 that the user is in the general proximity of other users that incurred an expense. For example, the communication unit includes a NFC chip or uses Bluetooth® technology to detects the presence of other users and transmits a notification to the monetary request module 152.

The monetary request module 152 receives information for sharing the expense. In one embodiment, the monetary request module 152 receives information from a user via a user interface. For example, the user manually inputs the amount of the bill and identifies the people in their social network associated with the bill. In another embodiment, the monetary request module 152 receives information from a billing party, such as a restaurant, and the main payor manually chooses other users to share the expense with via their social network graph. In yet another embodiment, the information is received from an online store where the user made a purchase. For example, the monetary request module 152 receives order information or payment information from an online store. The monetary request module 152 identifies the users that are sharing the expense.

The monetary request module 152 generates an invoice and sends a notification to at least one user via the communication unit 171. In one embodiment, the notification is at least one of an email message, a comment or post on a social network, text message, multimedia message, or an alert notification that the user interface engine 158 sends to the user device 115 via the social network application. In another embodiment, the notification includes the invoice. In one embodiment, the monetary request module 152 receives an authorization from the payee for sending the notification to the at least one user. In one embodiment, the amounts owed by each person are different and the monetary request module 152 generates a different invoice for each person. In yet another embodiment, the payee enters multiple items and amounts that are attributed to each user and the monetary request module 152 sums the amounts for each user and generates an invoice that includes the summed amounts.

The payment processing engine 154 is software including routines for triggering payments or monetary transfers in response to receiving and authorization from the invoiced user to trigger payment via the communication unit 171. In one embodiment, the payment processing engine 154 is a set of instructions executable by the processor 165 to provide the functionality described below for triggering payments or monetary transfers. In another embodiment, the payment processing engine 154 is stored in the memory 167 of the computing device 150 and is accessible and executable by the processor 165. In either embodiment, the payment processing engine 154 is coupled to the bus 170 for communication with the processor 165 and other components via signal line 176.

In one embodiment, the payment processing engine 154 receives an authorization for triggering a payment. In one embodiment, the trigger is received from a user of a social network. In one embodiment, the payment is associated with at least one of a credit card account, a banking account, a virtual currency account and a payment processing provider account such as a Google Checkout account. The payment processing engine 154 transfers money or other currency from one user's account to another user's account. In one embodiment, the payment processing engine 154 maintains an account for the user and deducts money or other currency from the account each time the user authorizes a payment.

The financial institution interface module 156 is software including routines for communicating with a financial institution server 135 via the communication unit 171. In one embodiment, the financial institution interface module 156 is a set of instructions executable by the processor 165 to provide the functionality described below for communicating with financial institution servers 135. In another embodiment, the financial institution interface module 156 is stored in the memory 167 of the computing device 150 and is accessible and executable by the processor 165. In either embodiment, the financial institution interface module 156 is coupled to the bus 170 for communication with the processor 165 and other components via signal line 178.

The user interface engine 158 is software including routines for generating a user interface that receives inputs from users and/or displays information to users via the communication unit 171. The user interface is transmitted and displayed on a user device 115, such as a mobile device or a desktop computer. In one embodiment, the user interface engine 158 is a set of instructions executable by the processor 165 to provide the functionality described below for receiving inputs from user and/or displaying information to users. In another embodiment, the user interface engine 158 is stored in the memory 167 of the computing device 150 and is accessible and executable by the processor 165. In either embodiment, the user interface engine 158 is coupled to the bus 170 for communication with the processor 165 and other components via signal line 179.

The registration module 160 is software including routines for registering payment types and associating the payment types with a user. In one embodiment, the registration module 160 is a set of instructions executable by the processor 165 to provide the functionality described below for registering payment types, such as account numbers for a bank and credit card information and for storing the payment types so that the user does not have to retype the information each type a transaction is processed. In another embodiment, the registration module 160 is stored in the memory 167 of the computing device 150 and is accessible and executable by the processor 165. In either embodiment, the registration module 160 is coupled to the bus 170 for communication with the processor 165 and other components via signal line 180.

The group engine 162 is software including routines for suggesting and generating groups for billing and transferring money or other currency. In one embodiment, the group engine 162 is a set of instructions executable by the processor 165 to generate groups in response to receiving a user request via the user interface. In another embodiment, the group engine 162 is stored in the memory 167 of the computing device 150 and is accessible and executable by the processor 165. In either embodiment, the group engine 162 is coupled to the bus 170 for communication with the processor 165 and other components via signal line 181. In one embodiment, the group engine 162 generates a group including at least two users based on a common feature that the two users share. In one embodiment, the group engine 162 generates a suggestion to the user to request a group in response to the user generating a one-time invoice. The suggestions are described in greater detail below with reference to FIG. 8. In one embodiment, the group is private and only viewable by the members of the group.

User Interface Engine 158

Figure 2:
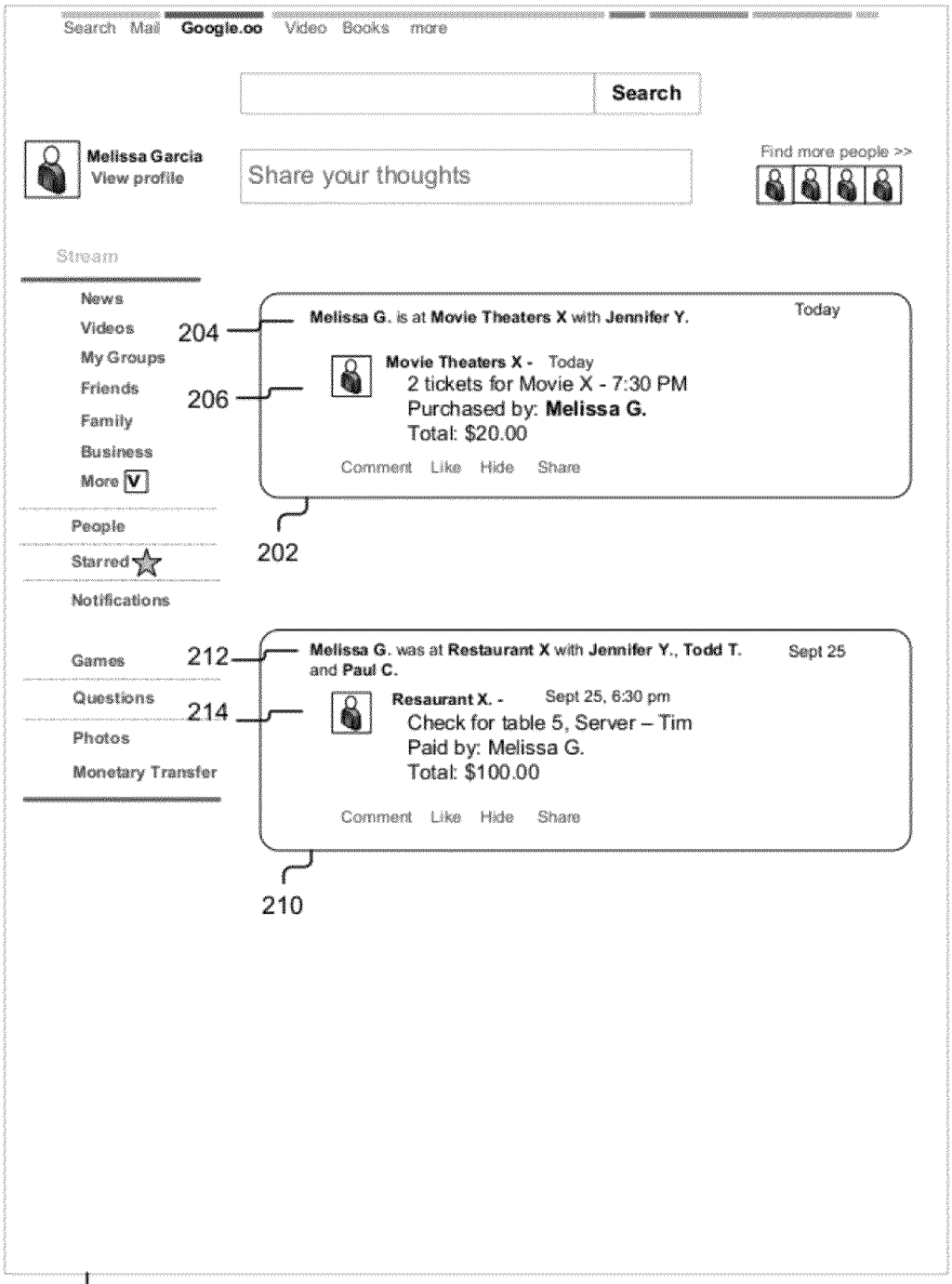
FIG. 2 is a graphic representation of a user interface that displays a stream of user activity.

Turning now to user interface engine 158, FIG. 2 is a graphic representation 250 of a user interface that is generated by the user interface engine 158 for displaying user activity and incurred expenses on a social network. Graphic representation 250 displays a stream of activity for a user. In the example, the stream of activity for Melissa Garcia includes check-in status updates. Additionally, check-in status updates include evidence of incurred expenses and payment of the expenses. In one embodiment, only the users that checked in with Melissa can view the costs associated with activities. This helps maintain the users' privacy because they might not want all their friends to know how much money or other currency they spend on activities. A first check-in 202 includes a status description 204 that indicates that a group including Melissa and a friend of Melissa, Jennifer Y., is at Movie Theaters X. In one embodiment, Melissa adds Jennifer to the check-in 202 to form the group. In another embodiment, Jennifer adds herself to the group by generating a check-in status update that indicates that she is at Movie Theaters X with Melissa. In another embodiment, Jennifer or Melissa acknowledge or verify that they are together at Movie Theaters X.

The first check-in 202 includes a comment 206 by Movie Theaters X that indicates that Melissa paid for the tickets. In one embodiment, the comment is a receipt that indicates that the user made the payment through the social network. In another embodiment, the comment is a receipt that indicates that the user made the payment through a retailer that sells movie tickets to Movie Theaters X. A second check-in 210 includes status description 212 that indicates that a group including Melissa, Jennifer Y., Todd T. and Paul C. visited or dined at Restaurant X together. The second check-in 210 includes a comment 214 that indicates that Melissa paid for a check that totals $100. In one embodiment, the comment or post 214 is generated in response to a payment for the check. In one embodiment, the payment is for paying at least a portion of the check or bill.

Figure 3:
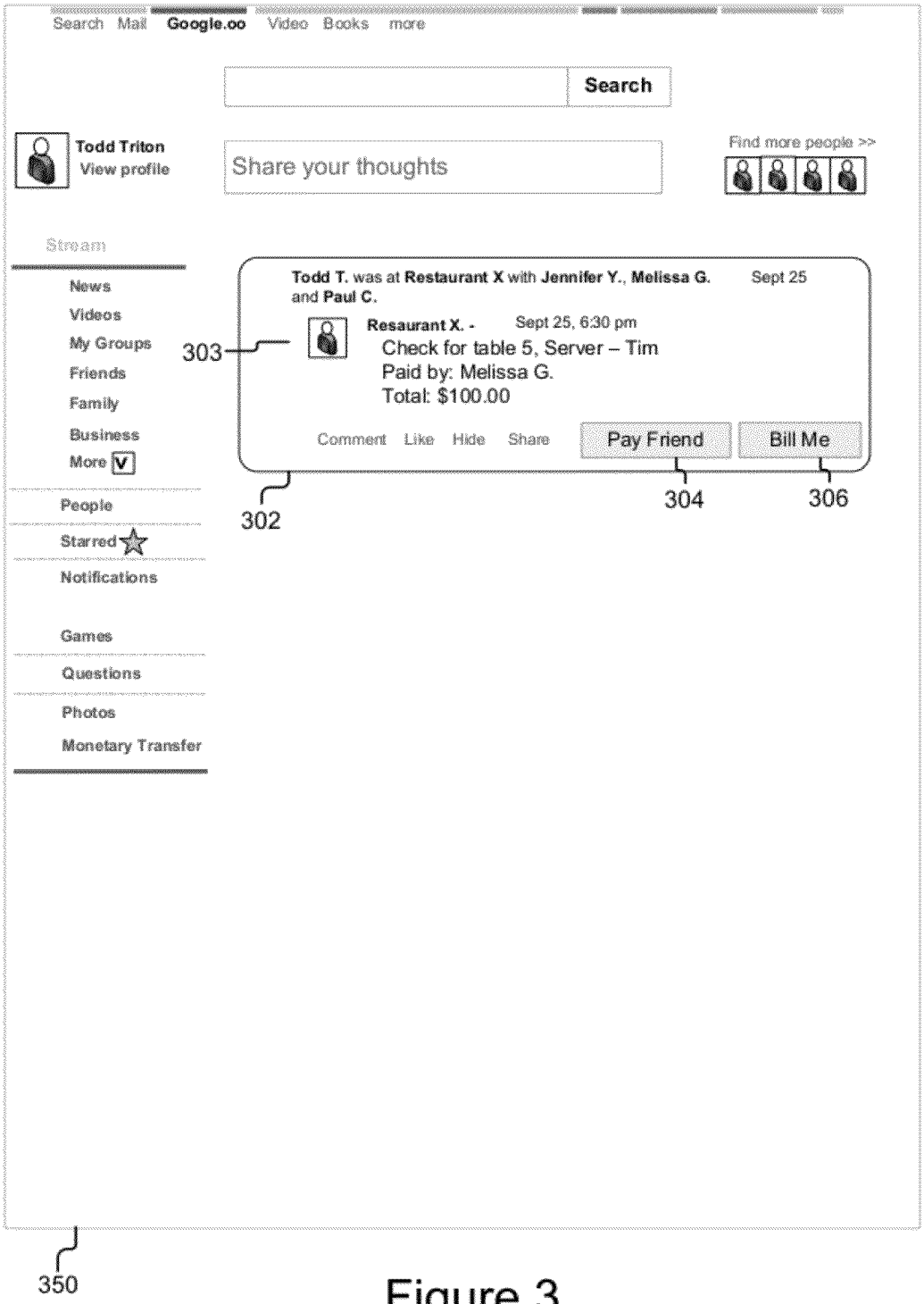
FIG. 3 is a graphic representation of a user interface that is generated by the user interface engine for displaying user activity and sharing expenses.

FIG. 3 is an embodiment of a graphic representation 350 of a user interface that is generated by the user interface engine 158 for displaying user activity and sharing expenses. Persons of ordinary skill in the art will recognize that the user interface can be displayed on any user device 115 including a personal computer, a mobile device or a table. Graphic representation 350 displays a stream of activity for a user. In the example, the stream of activity for Todd Triton includes at least one check-in status update. A check-in 302 includes a status that indicates that a group including Todd, Jennifer Y., Melissa G. and Paul C. visited or dined at Restaurant X together. Check-in 302 corresponds to check-in 210 on the stream of activity of Melissa in FIG. 2. Check-in 302 includes a comment 303 that indicates that Melissa paid for a check that totals $100. In one embodiment, comment 303 provides proof to Melissa and the others in the group that a payment was made or an expense was incurred.

Check-in 302 includes a pay button 304 for initiating a payment or processing a payment to a friend in the group. In one embodiment, Todd presses the pay button 304 to pay at least one person in the group. In one embodiment, Todd presses the pay button 304 to pay Melissa to cover his portion of the bill. In one embodiment, Todd places his phone close to Melissa's and the transaction is initiated via NFC technology built into the devices. Check-in 302 includes a bill button 306 for authorizing billing. In one embodiment, Todd presses the bill button 306 to authorize Melissa or another user in the group to send a bill to Todd. In another embodiment, Todd authorizes billing from others in the group by joining a check-in status update or acknowledging participation in the check-in status update. In another embodiment, in response to pressing the bill button 306, a message is sent to at least one user in the group that indicates that Todd has authorized billing from at least one person in the group.

Figure 4:
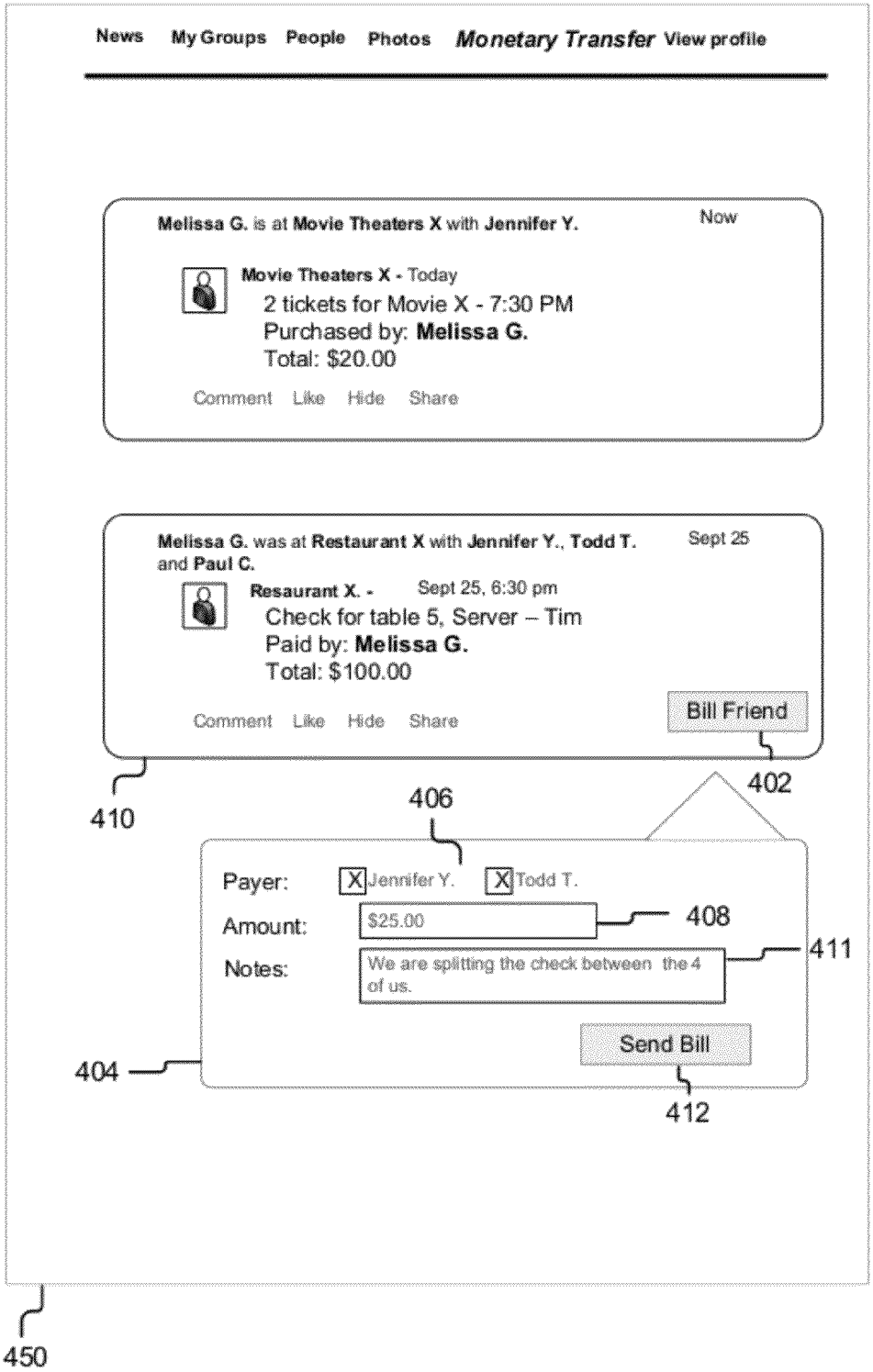
FIG. 4 is a graphic representation of a user interface that is generated by the user interface engine for sharing expenses.

FIG. 4 is an embodiment of a graphic representation 450 of a user interface that is generated by the user interface engine 158 for sharing expenses. Graphic representation 450 displays a stream of activity for user Melissa that includes check-in 410. Check-in 410 includes a bill button 402 for creating a bill and sending the bill to a friend or user in a group associated with the check-in 410. In response to pressing bill button 402, the user interface displays an area or an input form 404 for capturing information to generate the bill.

The input form 404 includes inputs for capturing at least one payer 406, an amount 408 for the bill and notes 411 for describing the bill or adding any supplemental information regarding the bill. In one embodiment, a list for selecting the at least one payer 406 is based on a group associated with the check-in 410. In one embodiment, the list for selecting the at least one payer 406 includes all users associated with check-in 410. In another embodiment, the list for selecting the at least one payer 406 is based on an authorization to bill between users. For example, because Paul did not authorize Melissa to bill him, the list for selecting the at least one payer 406 does not include Paul. However, because Jennifer and Todd authorized Melissa to bill them, the list for selecting the at least one payer 406 includes Jennifer and Todd. In response to pressing the send bill button 412, an invoice is generated and a notification is sent to the at least one payer 406. In one embodiment, the notification is an email message, a comment or post on a social network, text message, multimedia message, or sending an alert notification to the user device 115 via the social network application 109. In another embodiment, the notification includes the invoice. In one embodiment, the user can specify a different amount for each user. This is helpful when users incur different expenses, for example, when one user eats a salad and another user eats a steak and orders several drinks.

Figure 5:
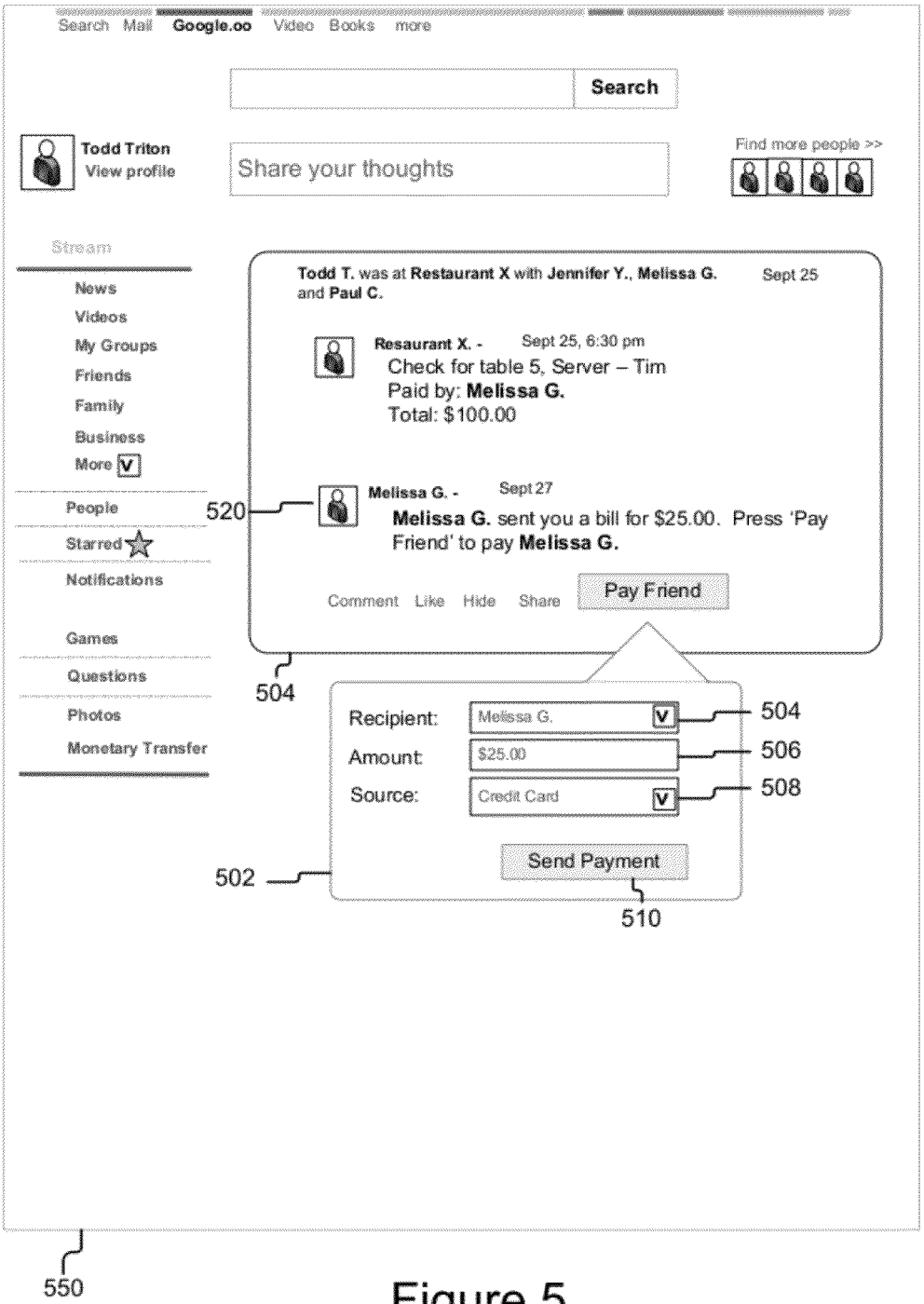
FIG. 5 is a graphic representation of a user interface that is generated by the user interface engine for the user to pay a friend.

FIG. 5 is a graphic representation of a user interface 550 that is generated by the user interface engine 158 for paying a friend on a social network. Graphic representation 550 displays a stream of activity for user Todd that includes check-in 504. Check-in 504 includes a comment 520 that indicates that Melissa billed Todd. In response to pressing pay button 304, the user interface displays an area or an input form 502 for capturing information to pay a friend.

The input form 502 includes inputs for capturing a recipient 504 of a payment, an amount 506 of the payment and a source 508 for providing the funds to make the payment. In one embodiment, a list for selecting the recipient 504 is based on a group associated with the check-in 504. In one embodiment, the list for selecting the recipient 504 includes all users associated with check-in 504. In another embodiment, the list for selecting the recipient 504 is based on an invoice. For example, because comment 520 indicates that Melissa invoiced Todd, the list for selecting the recipient 504 includes at least Melissa. In one embodiment, a list for selecting the source 508 for providing the funds to make the payment includes at least one account. A type of the at least one account is a credit card account, a banking account, a virtual currency account and a payment processing provider account such as a Google Checkout account.

In response to pressing the send payment button 510, a process for transferring funds of any type of currency is initiated. The process is based on the type of the account selected as the source 508. In one embodiment, for a credit card, banking account type or payment processing provider account, the financial institution interface module 156 communicates with the financial institution server 135 to transfer funds. In another embodiment, the payment processing engine 154 is capable of communication with the financial institution server 135 to transfer funds. In another embodiment, a virtual currency account type is associated with the social network and the payment processing engine 154 communicates with the social network sever 101 to transfer the funds. A virtual currency account allows a user to convert nonmonetary sources into money. For example, if a user accumulates credits in a game, the social network server 101 or the payment processing engine 154 converts the credits into money.

Figure 6:
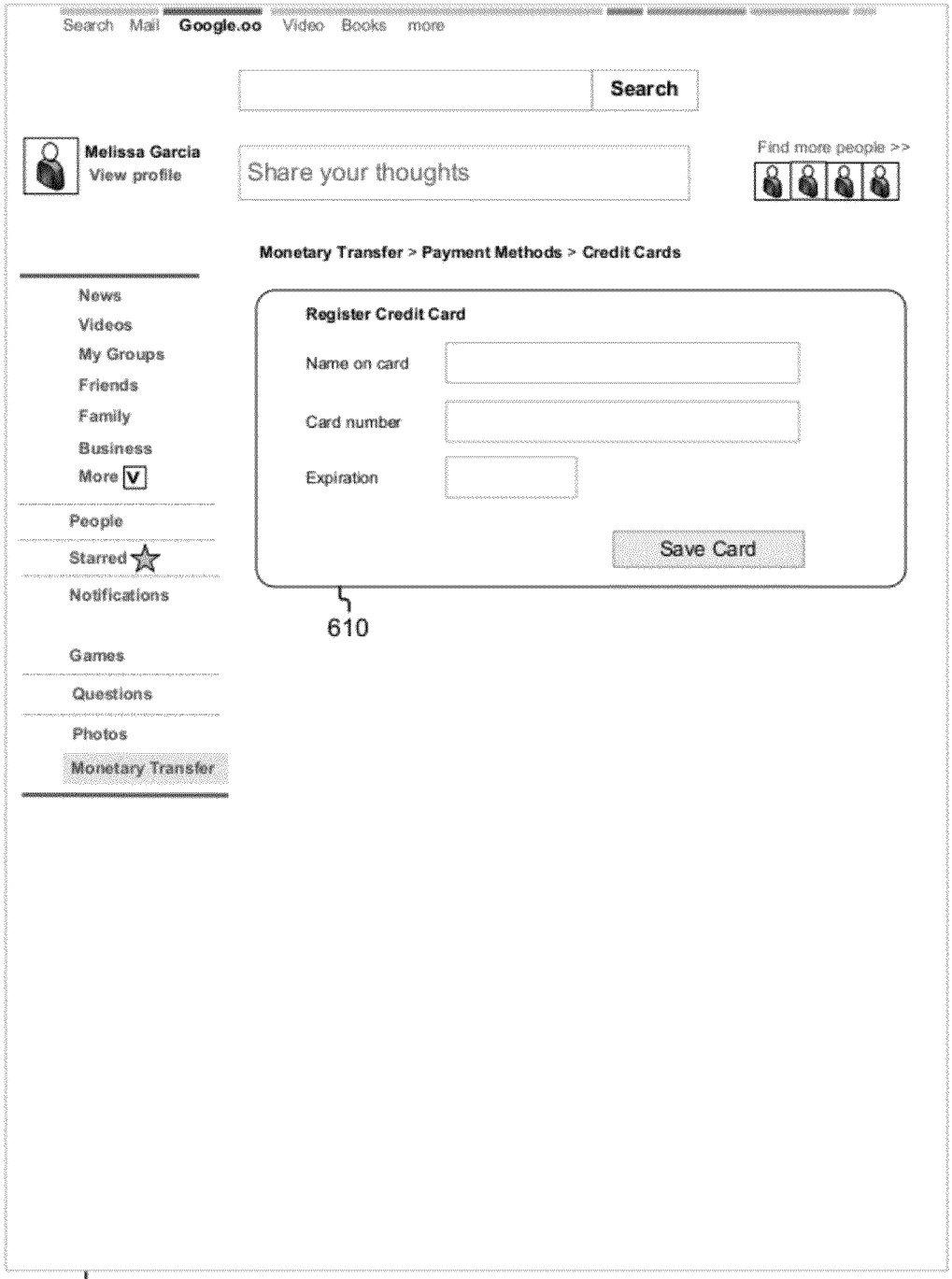
FIG. 6 is a graphic representation of a user interface that is generated by the user interface engine for the user to register a method of payment.

FIG. 6 is a graphic representation of a user interface 650 that is generated by the user interface engine 158 for the user to register a source or method of payment. Registering a source or method of payment associates an account with the user. In one embodiment, one or more accounts are associated with the user. Graphic representation 650 displays an input form 610 for capturing information to register a method of payment. For example, input form 610 includes inputs for capturing credit card account information. In another embodiment, input form 610 includes inputs for capturing bank card account information, virtual currency account information or payment processing provider account information.

Figure 7:
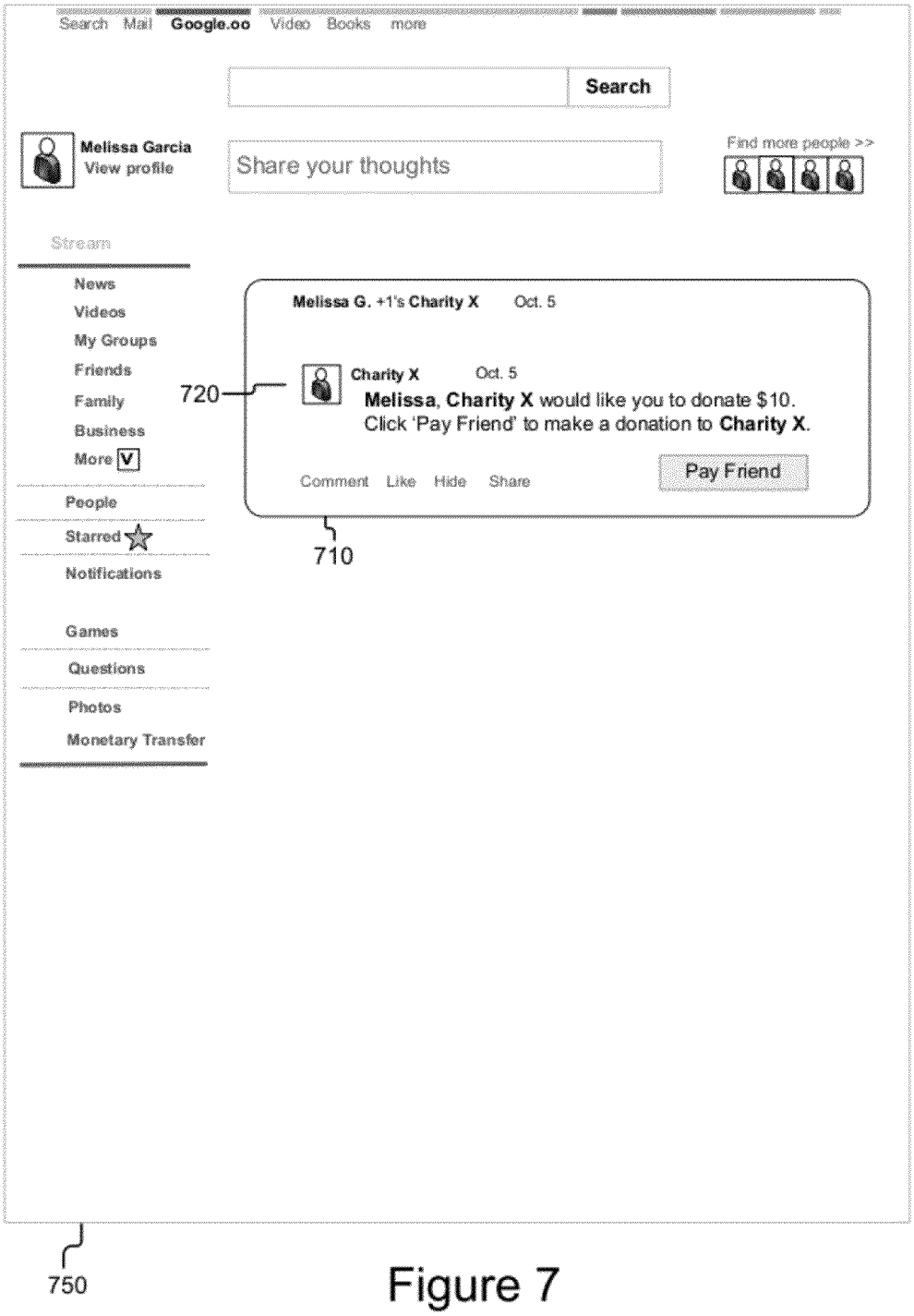
FIG. 7 is a graphic representation of a user interface that is generated by the user interface engine for the user to pay an organization.

FIG. 7 is a graphic representation of a user interface 750 that is generated by the user interface engine 158 for the user to donate to an organization. Graphic representation 750 displays a stream of activity for user Melissa that includes an approval 710 of Charity X. In response to approving of Charity X, Charity X sent a notification 720 to Melissa that requests a donation to Charity X. In one embodiment, the notification 720 is one of an email message, a comment or post on a social network, text message or a multimedia message. To initiate a donation or pay Charity X, Melissa presses the pay button 304. In one embodiment, the monetary request module 152 only generates requests for donations when the user indicates an approval of the group. This avoids a user becoming annoyed by requests for monetary from unknown organizations.

Figure 8:
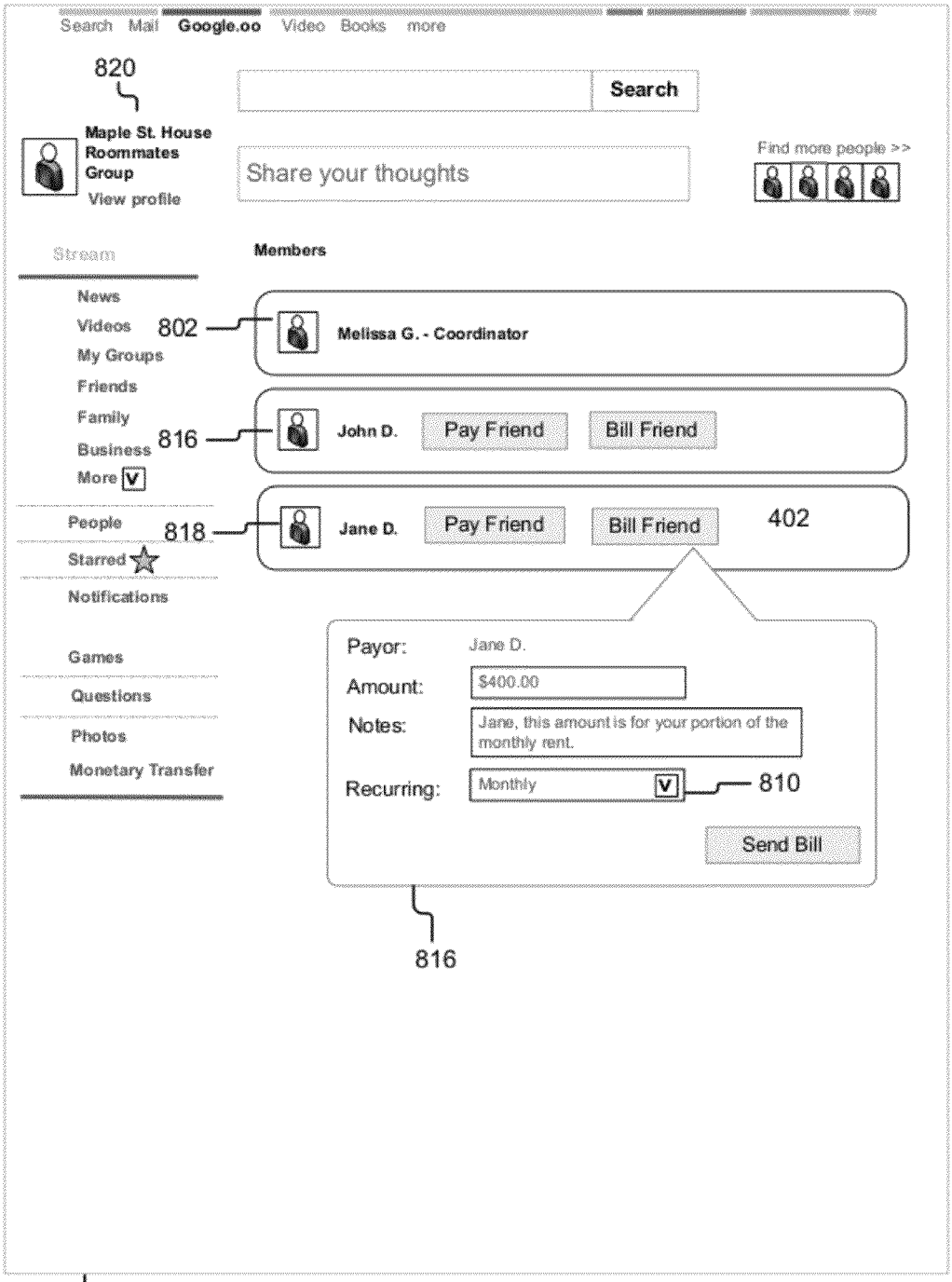
FIG. 8 is a graphic representation of a user interface that is generated by the user interface engine for the user to bill another user in a group.

FIG. 8 is a graphic representation 850 of a user interface that is generated by the user interface engine 158 for the user to bill and pay another user in a group. Graphic representation 850 displays a group 820 of roommates of a house to share expenses and pay each other. In one embodiment, users of the group manually create the group 820. In another embodiment, the group 820 is created based on at least one interaction between the users. For example, Melissa billed or sent an invoice to her roommates, John D. and Jane D., for sharing a portion of rent cost of a house. Based on the invoice or incurred expense, the group engine 162 generates a suggestion for Melissa to generate a group for sharing expenses. In another embodiment, the group engine 162 creates a group 820 based on recurring interactions between users. For example, Melissa billed or sent an invoice to her roommates a plurality of times for the same amount each time. Based on the similar invoices or incurred expenses, the group engine 162 generates a suggestion for Melissa to approve the group engine 162 generating a group for sharing the expense.

In one embodiment, group 820 includes one or more users. In this example, group 820 includes user 802, user 816 and user 818. User 802 is designated as a coordinator of the group. The coordinator has authorization to bill other users in the group. In response to pressing bill button 402, the user interface displays an area or an input form 816 for capturing information to bill another user in the group.

The input form 816 includes an option 810 for creating a recurring bill. The option 810 indicates an interval of time for recurring and sending the bill. The interval of time is any interval that corresponds to an established frequency for remittance of a bill. In this example, the roommates pay a monthly rent for the house. Therefore, the option 810 is set on a monthly schedule. In response to pressing the send bill button 412, the user interface engine 158 generates a recurring monthly notification that is displayed as part of the user interface or will be sent to user 818 for an amount of $400.00. In another embodiment, the bill is a one-time billing notification.

In one embodiment, only the user 802 that is designated as the coordinator has authorization to create and send invoices to other users in the group. In another embodiment, the group includes a plurality of coordinators. For example, user 802 and user 816 are coordinators of the group. This is useful because the housemates have a plurality of bills to pay such as rent, utilities, rental insurance, etc. Different users are assigned to pay different bills. Therefore, each user that is assigned to at least one bill has authorization to share the bill by billing other users for their portion of the bill. For example, user 802 coordinates the rental bill and user 816 coordinates the utilities bill. In another embodiment, all users in the group are authorized to bill each other.

Figure 9:
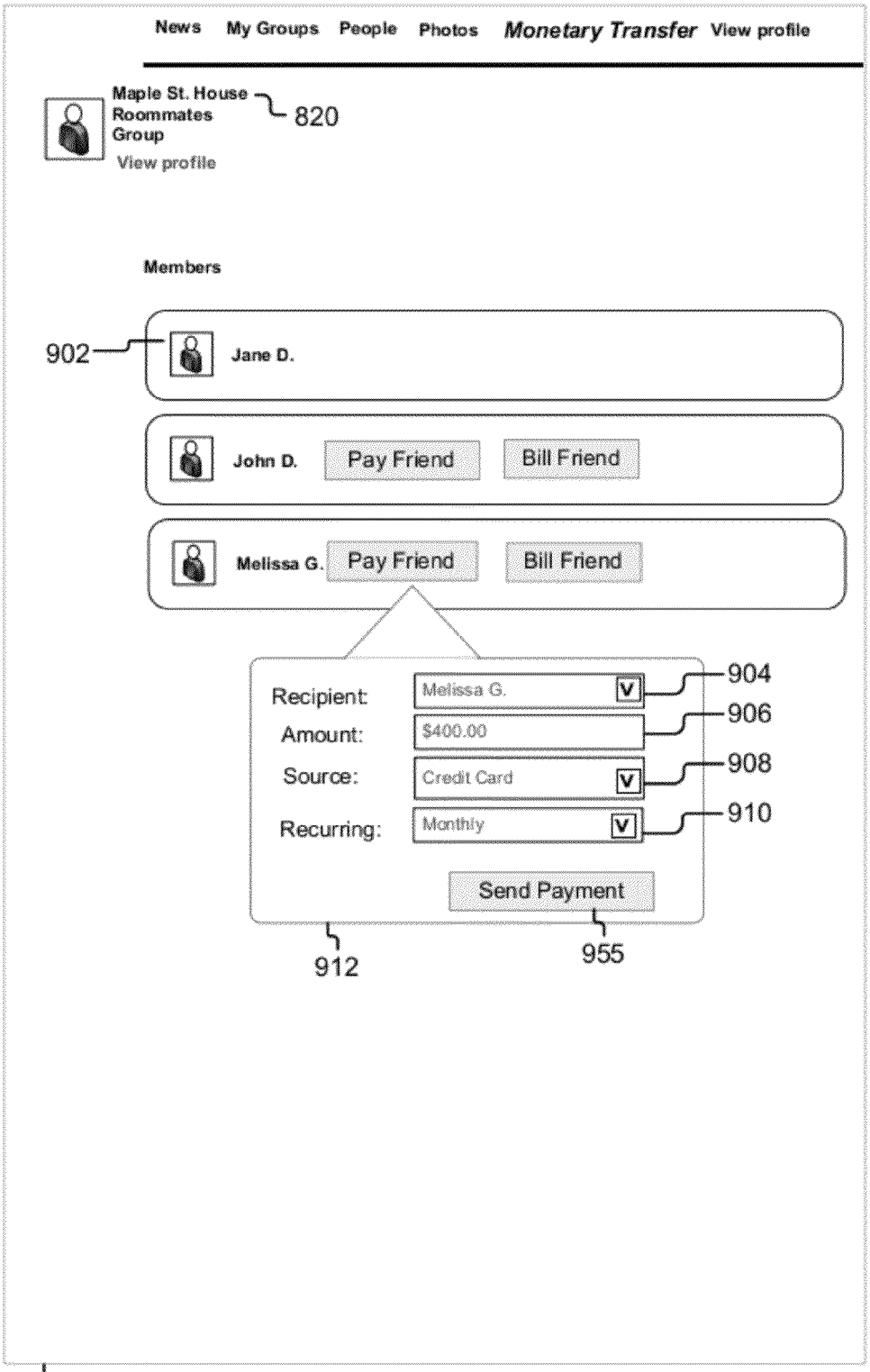
FIG. 9 is a graphic representation of a user interface that is generated by the user interface engine for the user to pay another user in a group.

FIG. 9 is a graphic representation 950 of a user interface that is generated by the user interface engine 158 for the user to pay another user in a group. Graphic representation 950 displays the group 820 of roommates of a house to share expenses and pay each other. In response to pressing pay button 304, the user interface displays an input form 912 for capturing information to bill another user in the group.

The input form 912 includes a recipient 904, an amount 906, source or method of payment 908 and an option 910 for creating a recurring payment. In response to pressing send payment button 955, a recurring monthly payment will be sent to recipient 904 for an amount of $400.00. In another embodiment, the payment is a one-time payment.

Figure 10:
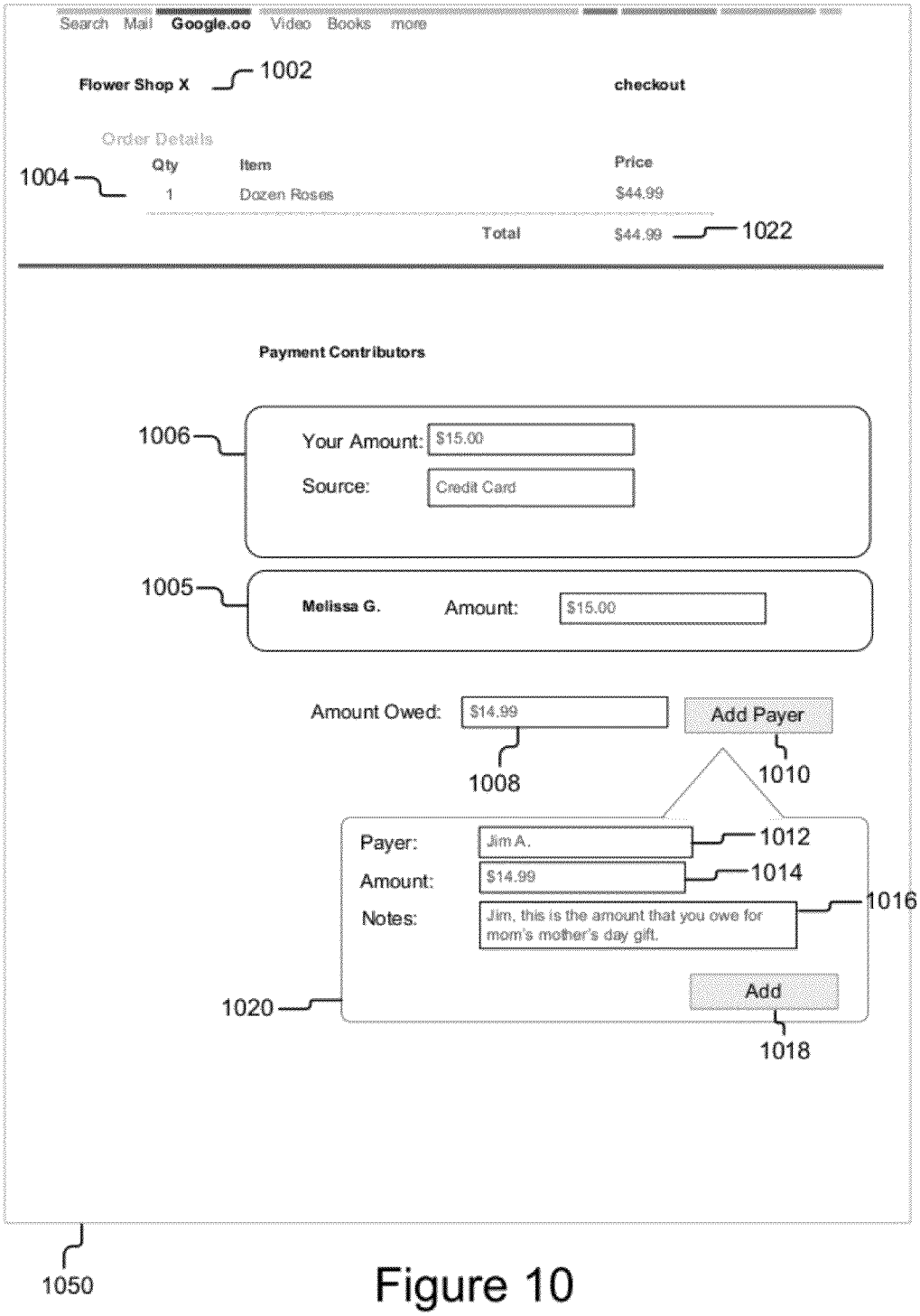
FIG. 10 is a graphic representation of a user interface for sharing payment of a gift purchase with friends.

FIG. 10 is a graphic representation 1050 of a user interface that is generated by the user interface engine 158 for sharing payment of a purchase with friends. Graphic representation 1050 displays a checkout screen for paying for products in an online shopping cart for a retailer 1002. Graphic representation 1050 displays order details such as at least one item ordered 1004 and a total amount 1022 for purchasing the at least one item ordered 1004. In one embodiment, a user shares the payment for the product with at least one friend on a social network. Payment contribution 1006 indicates that a first user is billed for a portion of the total amount 1022. In one embodiment, the first user creates the order using the online shopping cart. Payment contribution 1005 indicates that a second user is billed for at least a portion of the total amount 1022. In one embodiment, the first user and the second user are required to be friends on a social network. In another embodiment, the first user and second user are required to be members of at least one common group on the social network. In another embodiment, the first user is required to have authorization from the second user to send a bill or invoice to the second user.

In response to pressing add payer button 1010, the user interface displays an input form 1020 for capturing information to request that a user contribute to the purchase. The input form 1020 includes inputs for capturing a payer 1012, an amount 1014 for contributing to the purchase by the payer and notes 1016 for describing the purchase or adding any supplemental information regarding the purchase. In one embodiment, input form 1020 includes a list for selecting the payer 1012 that is based on friends of the user in a social network. Amount owed 1008 indicates an amount that equals a sum of the amounts of the contributions 1006, 1005 subtracted from the total amount 1022. In response to pressing the add button 1018, the user interface engine 158 generates a request for contributing to the purchase and sends a notification including the request to the payer 1012.

In one embodiment, the portion of the total amount 1022 that is billed to the first user is zero and at least the portion of the total amount 1022 that is billed to the second user is equal to the total amount 1022. This is useful when the first user does not have funds or a source of payment to contribute to the purchase. The total amount 1022 is assigned to the second user for making the purchase. For example, a family member that does not have a source of payment creates an order and shares the payment with a relative for purchasing. The advantage is that the relative does not have to search for an item such as a gift for the family member. The family member adds the item to the shopping cart and creates the order. The relative receives a notification that request payment for the order and the relative makes a payment to complete the order.

Figure 11:
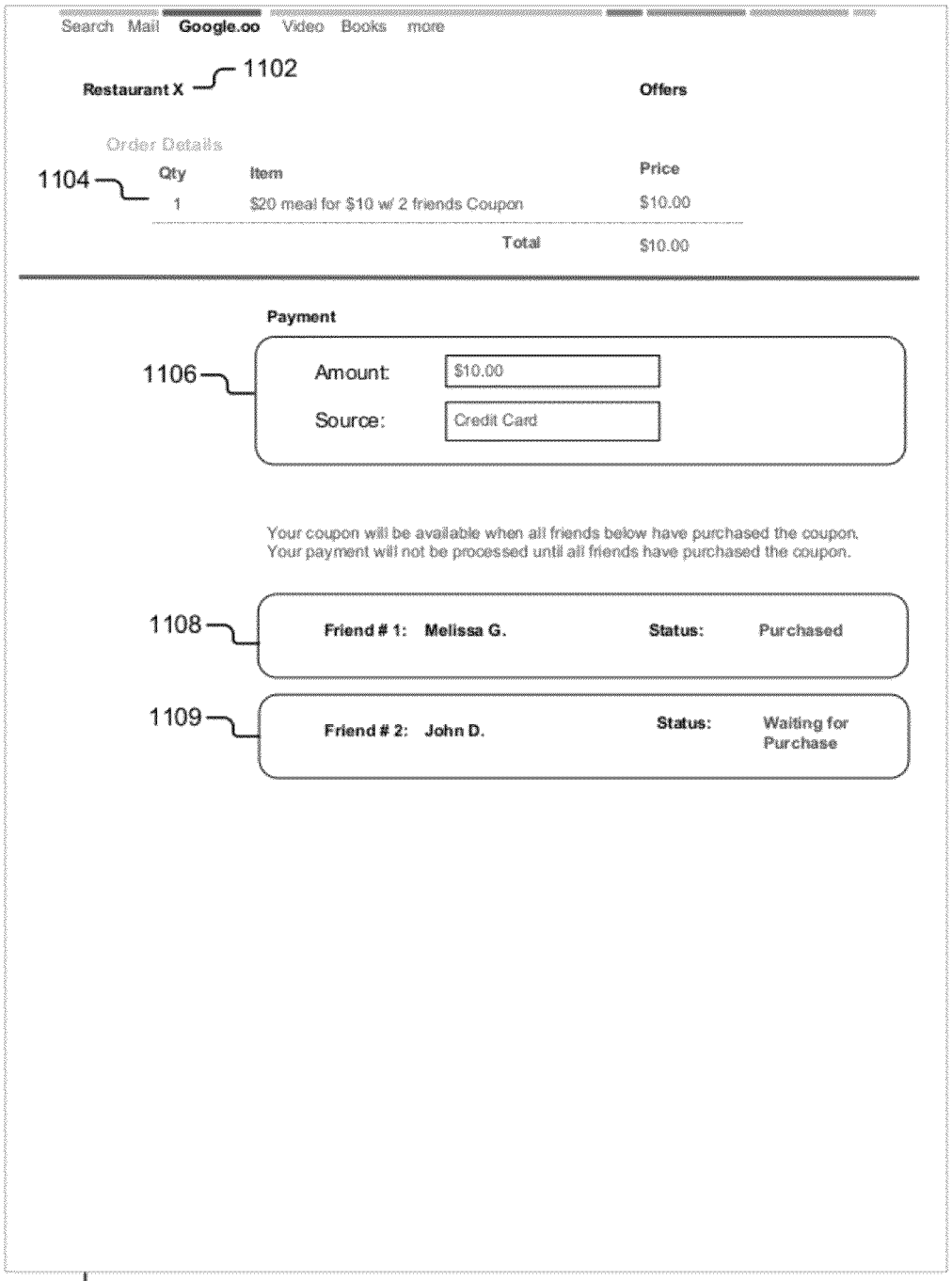
FIG. 11 is a graphic representation of a user interface for sharing payment of a meal with friends.

FIG. 11 is a graphic representation 1150 of a user interface that is generated by the user interface engine 158 for sharing payment of a group purchase with friends. Graphic representation 1150 displays a checkout screen for paying for a coupon 1104 that requires a group purchase in an online shopping cart of retailer 1102. Purchasing the item 1104 by a user requires that a group of friends of the user also purchase the item 1104. The group of friends includes at least one other user. In this example, purchasing the item 1104 requires that two other users purchase item 1104. A payment 1106 by the user indicates an amount and source or method of payment. The user selects at least one friend to share the purchase to satisfy a requirement that others must also make a purchase. The at least one friend receives a notification for purchasing the item 1104 and makes a payment for purchasing item 1104. A first friend purchase 1108 indicates that the user notified Melissa G. of the group purchase and Melissa G. purchased item 1104.

In one embodiment, the user and Melissa G. purchased the item 1104 by providing a source or method of payment and an authorization to process the method of payment. For example, the payment 1106 indicates that the user provided authorization to charge a credit card for an amount. A second friend purchase 1109 indicates that user notified John D. of the group purchase. However, the second friend purchase 1109 indicates that John D. has not purchased the item 1104. In another embodiment, an order of item 1104 is not complete until the user and the group of friends of the user purchases the item 1104.

Methods

In one embodiment, data is stored in the memory 167 of the computing device 150, further described in conjunction with FIG. 1*b*, so that execution of the data by the processor 165 included in the computing device causes execution of the functionality described below in conjunction with FIGS. 12 and 13.

Figure 12:
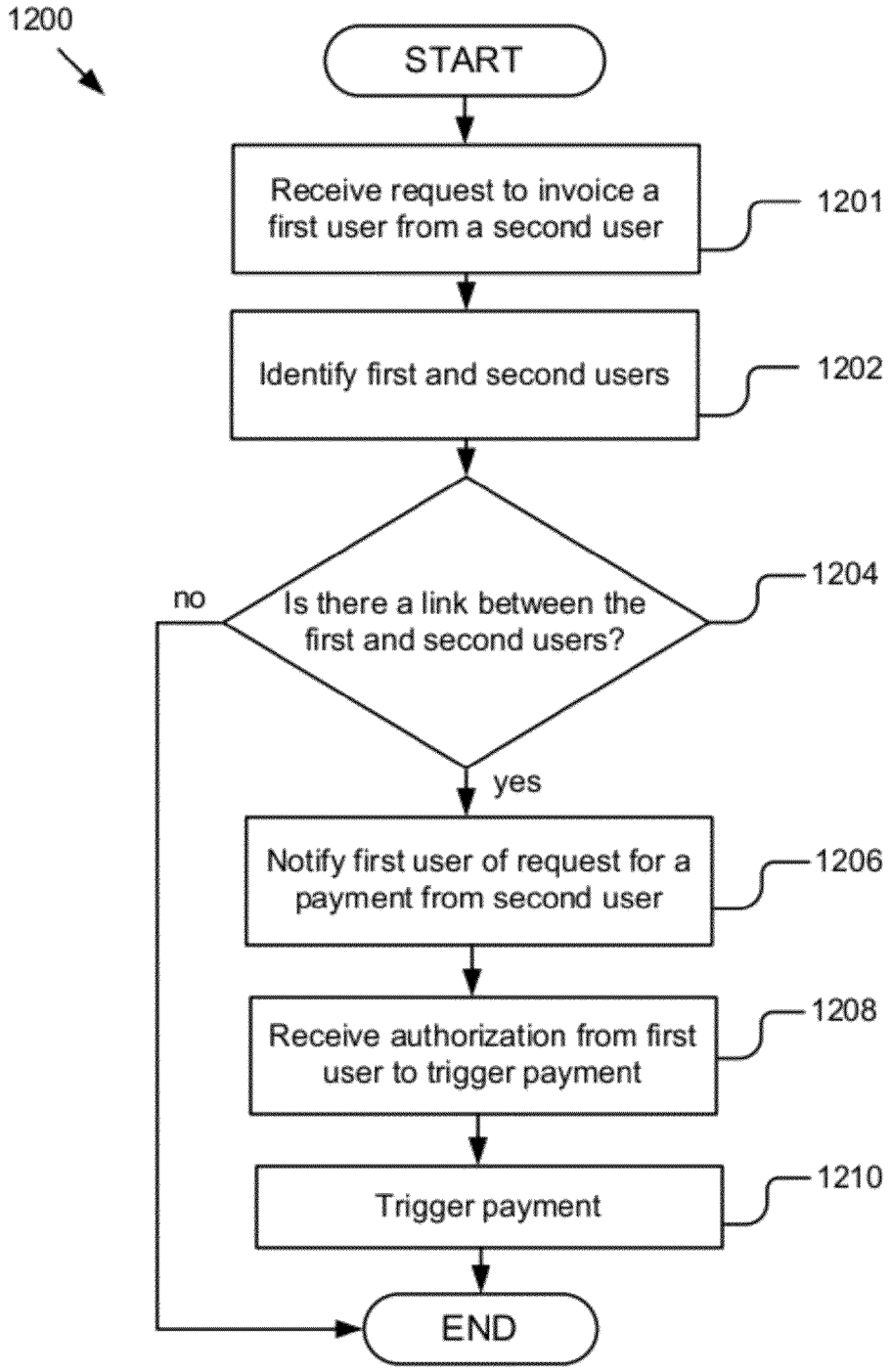
FIG. 12 is a flow diagram of one embodiment of a method for billing a user on a social network.

FIG. 12 is a flow diagram 1200 of one embodiment of a method for billing a user on a social network. The monetary request module 152 receives 1201 a request for invoicing a first user by a second user via the communication unit 171. The monetary request module 152 identifies 1202 the first user and the second user. The monetary request module 152 determines 1204 where there is a link between the first user and the second user. In one embodiment, the monetary request module 154 determines whether the first user and the second user are friends on a social network. In another embodiment, the monetary request module 154 determines whether the first user authorizes the second user to invoice the first user. If there is no link between the first and second user, the process ends. The user interface engine 158 notifies 1206 the first user of the request for payment from the second user via communication unit 171. In one embodiment, the user interface engine 158 notifies the first user by sending an email message, creating a comment or post on a social network, text messaging or sending a multimedia message. The user interface engine 158 receives 1208 authorization from the first user to trigger a payment for paying the second user. The payment processing engine 154 triggers 1210 the payment for paying the second user. For example, the payment processing engine 154 charges the credit card, converts virtual currency into money, etc. In one embodiment, the payment processing engine 154 generates a request for a funds transfer that is transmitted to the financial institution interface module 156. The financial interface module 156 contacts the financial institution server 135 via communication unit 171 to receive payment. For example, the financial interface module 156 transmits a request to the financial institution server 135 that includes the accounting and routing number of an electronic check along with the amount of the check.

Figure 13:
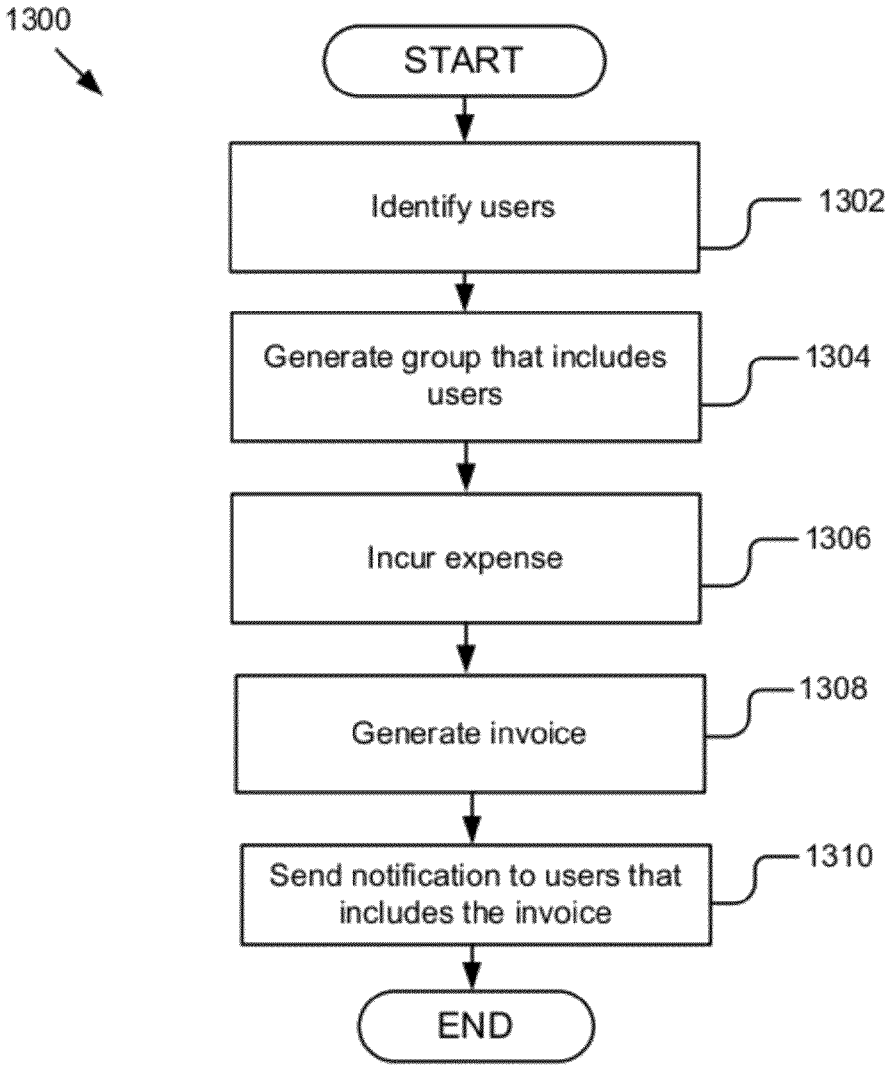
FIG. 13 is a flow diagram of one embodiment of a method for method for sharing an expenditure between members of a social network.

FIG. 13 is a flow diagram 1300 of one embodiment of a method for sharing an expenditure between members of a group on a social network. In one embodiment, the expenditure is associated with an interaction on the social network between the members. In another embodiment, the expenditure is associated with an order on a retailer website. The monetary request module 152 identifies 1302 users on a social network. The group engine 162 generates 1304 a group that includes the users based at least in part on at least one common feature between the users. A common feature includes at least one of an activity and an interest. In one embodiment, the activity is a check-in to an event or place of business.

At least one of the users included in the group incurs 1306 an expense. In one embodiment, the expense is incurred by ordering from an online retailer. In another embodiment, the expense is incurred by making a purchase at a physical location of a business. In yet another embodiment, the expense is incurred by joining a group that solicits donations from its members. The monetary request module 152 generates 1308 an invoice for paying for the expense. The user interface engine 158 sends 1310 a notification to at least one of the users that includes the invoice via the communication unit 171.

In one embodiment, the expense is a recurring expense. In one embodiment, generating the group includes creating a recurring invoice for paying for the recurring expense. In another embodiment, the expenditure is associated with an interaction on the social network between users. In yet another embodiment, a relationship between the users is generated. In one embodiment, the relationship includes at least one of a friend association and a group association. In one embodiment, the invoice is paid by users while they are still at the event where the expense was occurred. For example, users can pay for a restaurant bill using their mobile phones while they are still at the restaurant.

The foregoing description of the embodiments of the specification has been presented for the purposes of illustration and description. It is not intended to be exhaustive or to limit the specification to the precise form disclosed. Many modifications and variations are possible in light of the above teaching. It is intended that the scope of the disclosure be limited not by this detailed description, but rather by the claims of this application. As will be understood by those familiar with the art, the specification may be embodied in other specific forms without departing from the spirit or essential characteristics thereof. Likewise, the particular naming and division of the modules, routines, features, attributes, methodologies and other aspects are not mandatory or significant, and the mechanisms that implement the specification or its features may have different names, divisions and/or formats. Furthermore, as will be apparent to one of ordinary skill in the relevant art, the modules, routines, features, attributes, methodologies and other aspects of the disclosure can be implemented as software, hardware, firmware or any combination of the three. Also, wherever a component, an example of which is a module, of the specification is implemented as software, the component can be implemented as a standalone program, as part of a larger program, as a plurality of separate programs, as a statically or dynamically linked library, as a kernel loadable module, as a device driver, and/or in every and any other way known now or in the future to those of ordinary skill in the art of computer programming. Additionally, the disclosure is in no way limited to implementation in any specific programming language, or for any specific operating system or environment. Accordingly, the disclosure is intended to be illustrative, but not limiting, of the scope of the specification, which is set forth in the following claims.

What is claimed is:

1. A computer-implemented method for sharing expenses between members of a social network, the method comprising:

identifying, with one or more computing devices, a first user and a second user;

generating, with the one or more computing devices, a group on the social network that includes the first user and the second user based at least in part on the first and second users being associated with an activity related to an expense, wherein the social network is an association of users that have a relationship that is maintained in a social graph;

receiving from the first user the expense associated with the group on the social network;

generating, with the one or more computing devices, an invoice for paying at least a portion of the expense;

sending, with the one or more computing devices, a notification to the second user that includes the invoice;

receiving, with the one or more computing devices, authorization from the second user for triggering a payment of the invoice through the social network; and processing the payment.

2. The method of claim 1, further comprising generating a the relationship between the first user and the second user.

3. The method of claim 2, wherein the relationship is at least one of a friendship, a connection with a family member, a connection with a coworker, a connection with a group and an interest.

4. The method of claim 1, wherein processing the payment comprises receiving payment in virtual currency.

5. The method of claim 1, wherein the payment includes transferring currency to a first account from a second account associated with the second user and wherein a type of the first account and the second account is one from the group of a credit card account, a banking account or a payment processing provider account.

6. The method of claim 1, wherein the authorization includes a notification that the first and second users are in the same area using near field communication (NFC) technology or Bluetooth technology.

7. The method of claim 1, further comprising receiving authorization for sending the notification to the second user.

8. The method of claim 1, wherein the expense is associated with an interaction on the social network between the first user and the second user.

9. The method of claim 1, wherein the expense is a recurring expense and wherein generating the group includes creating a recurring invoice for paying for the recurring expense.

10. A system for sharing expenses between members of a social network comprising:

a monetary request module for identifying a first and a second user, for receiving from the first user an expense associated with a group on the social network, for generating an invoice for paying at least a portion of the expense and for sending a notification to the second user that includes the invoice;

a group engine coupled to the monetary request module, the group engine for generating the group on the social network that includes the first user and the second user based at least in part on the first and second users being associated with the activity related to the expense, wherein the social network is an association of users that have a relationship that is maintained in a social graph; and a payment processing engine coupled to the monetary request module, the payment processing engine for receiving authorization from the second user for triggering a payment of the invoice through the social network and for processing the payment.

11. The system of claim 10, wherein the monetary request module generates the relationship between the first user and second user.

12. The system of claim 11, wherein the relationship is at least one of a friendship, a connection with a family member, a connection with a coworker, a connection with a group and an interest.

13. The system of claim 10, wherein processing the payment comprises receiving payment in virtual currency.

14. The system of claim 10, wherein the payment includes transferring currency to a first account from a second account associated with the second user and wherein a type of the first account and the second account is one from the group of a credit card account, a banking account or a payment processing provider account.

15. The system of claim 10, wherein the authorization includes a notification that the first and second users are in the same area using near field communication (NFC) technology or Bluetooth technology.

16. The system of claim 10, wherein the monetary request module receives authorization for sending the notification to the second user.

17. The system of claim 10, wherein the expense is associated with an interaction on the social network between the first user and the second user.

18. The system of claim 10, wherein the expense is a recurring expense and wherein generating the group includes creating a recurring invoice for paying for the recurring expense.

19. A computer program product comprising a computer useable medium including a computer readable program, wherein the computer readable program when executed on a computer causes the computer to:

identify a first user and a second user;

generate a group on the social network that includes the first user and the second user based at least in part on the first and second users being associated with an activity related to an expense, wherein the social network is an association of users that have a relationship that is maintained in a social graph;

receive from the first user the expense associated with the group on the social network;

generate an invoice for paying at least a portion of the expense;

send a notification to the second user that includes the invoice;

receive authorization from the second user for triggering a payment of the invoice through the social network; and process the payment.

20. The computer program product of claim 19, further comprising generating the relationship between the first user and the second user, wherein the relationship includes at least one of a friend association and a group association.

* * * * *